United States Patent [19]

Chludil

[11] Patent Number: 4,656,803

[45] Date of Patent: Apr. 14, 1987

[54] MULTIPLY GLAZED WINDOW AND DOOR ASSEMBLIES WITH SCREENED BREATHING PASSAGES

[76] Inventor: Steven T. Chludil, 12050 Baumgartner Rd., St. Charles, Mich. 48655

[21] Appl. No.: 872,134

[22] Filed: Jun. 9, 1986

[51] Int. Cl.[4] ..... E06B 3/24

[52] U.S. Cl. ..... 52/304; 52/101; 52/172; 52/741

[58] Field of Search ..... 52/304, 303, 302, 101, 52/172, 741

[56] References Cited

U.S. PATENT DOCUMENTS

| | | | |
|---|---|---|---|
| 2,202,694 | 5/1940 | Haux | 52/304 |
| 2,719,341 | 10/1955 | Clerk | 52/304 |
| 2,880,475 | 4/1959 | Mills | 52/304 |
| 2,905,072 | 9/1959 | Oswald | 52/101 |
| 3,001,248 | 9/1961 | Verhagen | 52/304 |
| 3,429,084 | 2/1969 | Brewer | 52/101 |

FOREIGN PATENT DOCUMENTS

| | | | |
|---|---|---|---|
| 469433 | 7/1947 | Canada | 52/172 |
| 1064231 | 8/1959 | Fed. Rep. of Germany | 52/304 |
| 2319458 | 11/1974 | Fed. Rep. of Germany | 52/304 |
| 54098 | 11/1967 | German Democratic Rep. | 52/304 |
| 7366 | 4/1900 | United Kingdom | 52/304 |

*Primary Examiner*—Henry E. Raduazo

*Attorney, Agent, or Firm*—Learman & McCulloch

[57] ABSTRACT

A window or door assembly has spaced apart glass panes perimetrally sealed in sash members which include one or more breathing passages extending from a groove in the outer face of the sash through to the space between the panes. An elongate flat plate, with fine perforations, has perpendicularly extending, reduced width parallel end flanges configured to pilot into and seal off the groove on opposite sides of a passage, to provide an air circulation manifold under the plate. Preferably the plate is nailed in place.

8 Claims, 8 Drawing Figures

MULTIPLY GLAZED WINDOW AND DOOR ASSEMBLIES WITH SCREENED BREATHING PASSAGES

BACKGROUND OF THE INVENTION

This invention relates particularly to multiply glazed window and door systems of the type which include breathing openings in the sash to communicate with the insulating air chamber between the glass panels or glazings, for the purpose of providing the desired, limited, air circulation which provides certain advantages over sealed windows. Such systems permit a sufficient, yet restricted, air circulation so as to prevent steaming or condensation without appreciably effecting the insulating qualities of the unit. While functioning very well in this regard, windows and doors of this character, with breathing openings, are sometimes prevented from operating satisfactorily by insects such as wasps, which find the breathing passages attractive for nesting and the deposit of their eggs. While a variety of breather devices and perforated members for insect proofing have been proposed in the past, as illustrated in the following prior art patents, none have, to my knowledge, found any acceptance in the trade, or enjoyed any appreciable commercial success:

| | | | |
|---|---|---|---|
| 1,703,230 | Gillar | 2,905,072 | Oswald |
| 2,202,694 | Haux | 3,429,084 | Brewer |
| 2,231,514 | Verhagen | 4,282,691 | Risdon |
| 2,233,952 | Lipsett | 4,528,787 | Rittinge |
| 2,345,643 | Verhagen | | |

SUMMARY OF THE INVENTION

One of the prime objects of the present invention is to provide a unit wherein the entrance-barring screen which is used, is employed exteriorly of the breathing passage, and yet does not protrude from the window sash.

Still another object of the invention is to provide a unit having a screen device, for preventing insect deposits which tend not only to plug the device, but to be carried into the place between the window glazings.

A further object of the invention is to provide a unit of the character described, wherein the screen devices are readily fixed in position, and create manifold spaces, communicating with the breathing passages, which are of such volume as not to restrict the air circulation which is necessary.

Still another object of the invention is to provide a durable screen device which is extremely economical to market, and which can be readily, economically installed either in the factory, or by a home owner.

Still another object of the invention is to provide a screen unit which seals off the breather passage, except for a plurality of fine perforations which are too small to be attractive to insects for the deposit of eggs.

Other objects and advantages will become apparent by reference to the drawings, and the following specification:

IN THE DRAWINGS

GENERAL DESCRIPTION

Figure 1:
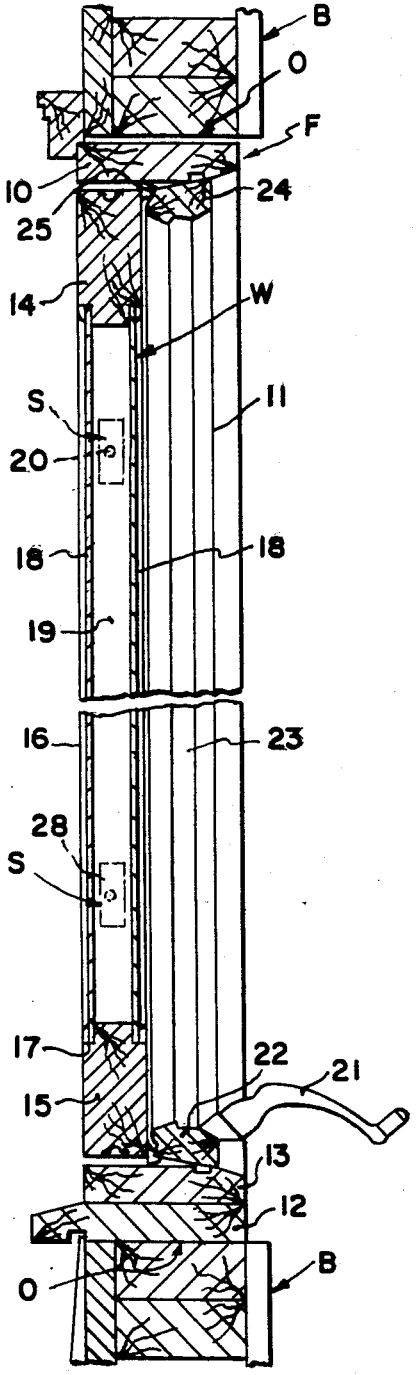
FIG. 1 is a sectional, elevational view illustrating a double glazed casement window with chain lines indicating the placement of the screen devices.
Figure 2:
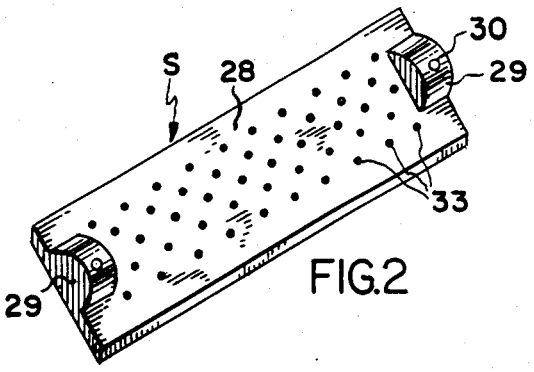
FIG. 2 is an isometric view, which illustrates the construction of the screen unit.

Referring now more particularly to the accompanying drawings, and in the first instance particularly to FIG. 1, a letter W generally refers to a double glazed casement window assembly which is mounted in the usual manner in a window frame, generally designated F, which is situated within a rectangular window opening, generally designated O, provided in the building structure, generally designated B. The frame F includes a header strip 10, jambs 11, and a sill made up of strips 12 and 13. As is usual, the casement window W has an upper sash 14, a lower sash 15, connected and side sash members 16. Provided in the recessed portion 17 of each of the sash members 14, 15 and 16, are spaced apart glazings or panes 18 which are suitably secured in position to provide an insulating air space 19 between them. Provided about six inches from the end of each of the jambs 16, to extend entirely through the sash and communicate with the air space 19, are breathing passages or vents 20 which, at their inner ends, for the sake of appearance, may be provided with ferrules (not shown).

The windows W are mounted at their upper and lower ends for pivotal movement to swing inwardly and outwardly about one side as is usual, with operation of the usual actuating handle 21. Handle 21 is mounted on a lower frame strips 22 which, with side strips 23, and a top strip 24, form a fixed inner sealing frame which also can mount an interior screen, if desired. Suitable perimetral weather-proofing seals can be provided, as indicated at 25, around the perimeter of the fixed frame formed by the members 22–24.

Figure 3:
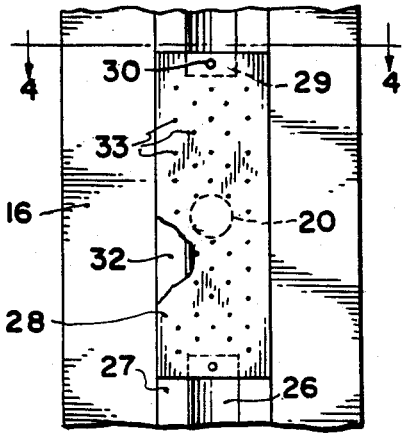
FIG. 3 is a greatly enlarged, side elevational view of a portion of the exterior perimetral face of one of the side-sash members, showing the screen device secured in position to provide an air manifold adjacent to the breathing port.
Figure 4:
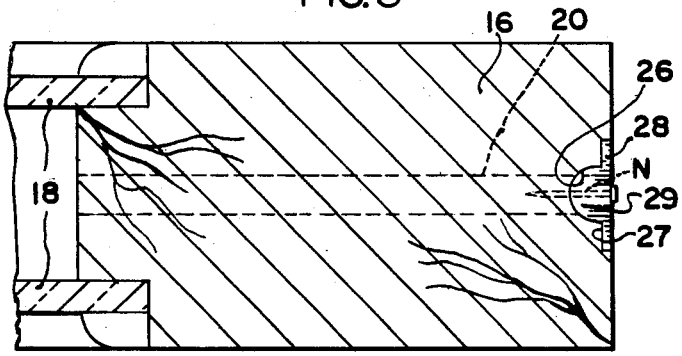
FIG. 4 is a fragmentary, transverse, sectional plan view taken on the line 4—4 of both FIGS. 1 and 3.

As FIGS. 3 and 4 particularly indicate, provided in the outer faces of the side sash members 16, are generally semi-circularly grooved or recessed portions 26 which communicate symmetrically with widthwisely-enlarged, shoulder-recesses or grooves 27. Provided to snugly seat within the recessed portions 26 and 27 opposite each passage 20, is a screen member S which comprises a plate 28 molded with end flanges 29 of semi-circular shape to fit the groove portions 26. The plate 28, as FIG. 4 clearly indicates, is sized to fit within the groove portions 27.

Provided in the plate member 28, and extending through the plate flanges 29, are nailing openings 30 through which nails N may extend down into the sash, as indicated in FIG. 4, to secure the member 28 in position. It is to be observed that the plate flanges 29 and plate 28 seal off the groove sections 26 and 27, respectively, on opposite sides of a breathing passage 20 (see FIG. 3), and function to define with the marginal wall of the groove section 26, air circulation manifold 32.

Provided in the plate 28 to communicate the outside atmosphere with manifold 32, are a series of fine perforations 33, which collectively are of such cross-sectional area as to approximate the cross-sectional area of the breathing passage 20, plate 28 being of a length such as to include perforations 33 sufficient to accomplish this. The plate 28, seating in the groove sections 26 and 27, as shown in FIG. 4, effectively prevents any insect from reaching the breathing port 20, without restricting the air circulation through passage 20. The screen unit S disclosed in FIGS. 2–5 can be molded very economically in an injection molding machine using a suitable plastic material.

Figure 6:
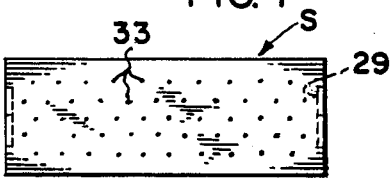
FIG. 6 is a top plan view of another embodiment of screen unit.
Figure 8:
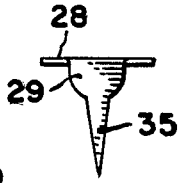
FIG. 8 is an end elevational view thereof.
Figure 5:
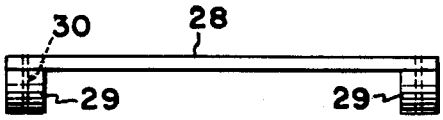
FIG. 5 is a side elevational view of the manifold creating screen unit.
Figure 7:
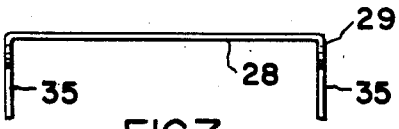
FIG. 7 is a side elevational view thereof.

Another form of the invention is disclosed in FIGS. 6–8, wherein the screen unit S is, instead, formed of metal, and barbs 35 extend integrally from the ends of the flanges 29. In this version of the invention, wherein like numerals for like parts have been used for purposes of convenience, the nailing openings 30 are, of course, omitted. It is presently thought that the embodiment of the invention disclosed in FIGS. 2–5 is the preferred form of the invention, because the flanges 29, pilot themselves into position in the groove section 26 before nails N are driven into the sash.

While several embodiments of the invention have been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. A multiply glazed, vented window or door assembly having spaced apart glass panes sealably secured perimetrally in parallel side sash members and parallel upper and lower sash members, at least one of said sash members having, in its outer surface, a linear groove perimetrally aligned with the space between said panes and further having a breathing port extending from the marginal wall of the groove through to the space between said panes; an elongate flat plate having fine perforations and parallel end flanges projecting generally perpendicularly therefrom, fitting into and sealing off said groove at spaced distances from said port to provide an air circulation manifold under said plate, the plate being sufficiently long to have sufficient perforations to provide a cross-sectional area which correlates with the cross-sectional area of said port; and means for securing said plate in place.

2. The invention of claim 1 wherein said securing means comprises nailing ports extending through each of said end flanges and said plate; and nails are driven through said ports into the said wall of the groove.

3. The invention of claim 1 wherein said flanges are of reduced width relative to said plate, and said groove communicates with a wider linear groove in the said other surface of the said one of said sash members, and said plate is of the thickness and width of said wider groove and seats therein.

4. The invention of claim 2 wherein said plate and flanges are molded of synthetic plastic material.

5. The invention of claim 1 wherein said securing means comprises anchoring barbs formed integrally on said flanges to extend outwardly therefrom.

6. The invention of claim 5 wherein said plate and flanges are formed of metal, and said barbs comprise wedge-shaped extensions extending centrally from said flange in the plane of said flanges.

7. For use in combination with a multiply-glazed, vented, window or door system, having spaced apart glass panels sealably secured perimetrally in parallel side sash members, and upper and lower sash members, and having a breathing port extending from the marginal wall of a configured groove in one of the sash members which has a portion of generally semi-cricular cross-section communicating with a wider shouldered groove portion; an elongate flat plate, having fine perforations and parallel semi-circular end flanges, of reduced width relative to said plate, projecting generally perpendicularly therefrom and fitting into and sealing off the semi-circular portion of said groove at spaced distances on opposite sides of the breathing port to provide an air circulation manifold under the plate, the plate being received in the shouldered portions of the groove; and means for securing the plate in position.

8. A method of installing screens to prevent insects from nesting in breathing ports provided in multiply-glazed window and door assemblies to communicate with the space between the spaced apart glass panes which are sealably secured perimetrally in parallel side sash members and upper and lower sash members, and wherein at least one of such sash members has in its outer surface, a linear groove having a section of semi-circular cross-section bounded by recess portions of increased width, the groove being perimetrally aligned with said breathing ports comprising the steps of: placing an elongate flat plate, having fine perforations and reduced width parallel end flanges of semi-circular cross-section, adjacent to said linear groove and piloting the flanges into the semi-circular section of the groove on opposite sides of a breathing port such that they seal off the groove on opposite sides of the breathing port and form an air circulation manifold under the plate; and securing the plate in position within the recess portions of increased width.

* * * * *